US009929499B2

(12) United States Patent
Thakare et al.

(10) Patent No.: US 9,929,499 B2
(45) Date of Patent: Mar. 27, 2018

(54) CONNECTOR ASSEMBLY WITH TORQUE SLEEVE

(71) Applicant: Amphenol Corporation, Wallingford, CT (US)

(72) Inventors: Rakesh Thakare, Danville, VA (US); Caichun Song, Jiangsu (CN); Michael Holland, Santa Barbara, CA (US)

(73) Assignee: Amphenol Corporation, Wallingford, CT (US)

( * ) Notice: Subject to any disclaimer, the term of this patent is extended or adjusted under 35 U.S.C. 154(b) by 0 days.

(21) Appl. No.: 15/713,209

(22) Filed: Sep. 22, 2017

(65) Prior Publication Data

US 2018/0062309 A1 Mar. 1, 2018

Related U.S. Application Data

(63) Continuation-in-part of application No. 15/254,360, filed on Sep. 1, 2016.

(51) Int. Cl.

| | |
|---|---|
| ***H01R 13/622*** | (2006.01) |
| ***H01R 9/05*** | (2006.01) |
| *H01R 13/05* | (2006.01) |

(52) U.S. Cl.

CPC ..... *H01R 13/622* (2013.01); *H01R 13/05* (2013.01)

(58) Field of Classification Search

CPC ..... H01R 13/622; H01R 9/05

See application file for complete search history.

(56) References Cited

U.S. PATENT DOCUMENTS

| | | | |
|---|---|---|---|
| 3,323,098 | A | 5/1967 | O'Keefe et al. |
| 4,116,521 | A | 9/1978 | Herrmann, Jr. |
| 4,408,821 | A | 10/1983 | Forney, Jr. |
| 4,441,775 | A | 4/1984 | Walters |
| 4,452,503 | A | 6/1984 | Forney, Jr. |
| 4,660,921 | A | 4/1987 | Hauver |
| 4,690,481 | A | 9/1987 | Randolph |
| 4,854,893 | A | 8/1989 | Morris |
| 5,002,503 | A | 3/1991 | Campbell et al. |
| 5,007,861 | A | 4/1991 | Stirling |
| 5,067,750 | A | 11/1991 | Minneman |
| 5,073,129 | A | 12/1991 | Szegda |
| 5,141,451 | A | 8/1992 | Down |
| 5,192,219 | A | 3/1993 | Fowler et al. |

(Continued)

*Primary Examiner* — Briggitte R Hammond
(74) *Attorney, Agent, or Firm* — Blank Rome LLP; Charles R. Wolfe, Jr.; Tara L. Marcus

(57) ABSTRACT

A connector assembly that has a connector configured to engage a mating connector that includes a coupling member rotatably coupled to a body. A gripping sleeve receives the body and the coupling member. A torque limiting feature provides first and second predetermined torque limits and includes a slip element associated with the gripping sleeve and cooperating engaging element associated with the coupling member. The slip element and the engaging element engage one another such that rotation of the gripping sleeve applies torque to and rotates the coupling member in a tightening direction until the first predetermined torque limit is reached when the slip element disengages from the engaging element and the gripping member rotates with respect to the coupling member in a loosening direction until the second predetermined torque limit is reach allowing the gripping sleeve to rotate the coupling member in the loosening direction.

23 Claims, 10 Drawing Sheets

(56) References Cited

U.S. PATENT DOCUMENTS

| | | | |
|---|---|---|---|
| 5,217,393 | A | 6/1993 | Del Negro et al. |
| 5,295,864 | A | 3/1994 | Birch et al. |
| 5,297,458 | A | 3/1994 | Smith et al. |
| 5,316,348 | A | 5/1994 | Franklin |
| 5,352,134 | A | 10/1994 | Jacobsen et al. |
| 5,435,745 | A | 7/1995 | Booth |
| 5,456,614 | A | 10/1995 | Szegda |
| 5,466,173 | A | 11/1995 | Down |
| 5,474,470 | A | 12/1995 | Hammond, Jr. |
| 5,499,934 | A | 3/1996 | Jacobsen et al. |
| 5,548,088 | A | 8/1996 | Gray et al. |
| 5,598,132 | A | 1/1997 | Stabile |
| 5,651,699 | A | 7/1997 | Holliday |
| 5,653,605 | A | 8/1997 | Woehl et al. |
| 5,660,565 | A | 8/1997 | Williams |
| 6,027,373 | A | 2/2000 | Gray et al. |
| 6,034,325 | A | 3/2000 | Nattel et al. |
| 6,331,123 | B1 | 12/2001 | Rodrigues |
| D462,327 | S | 9/2002 | Montena |
| 6,454,462 | B2 | 9/2002 | Nguyen et al. |
| 6,767,247 | B2 | 7/2004 | Rodrigues et al. |
| 6,808,415 | B1 | 10/2004 | Montena |
| 6,817,272 | B2 | 11/2004 | Holland |
| 6,884,115 | B2 | 4/2005 | Malloy |
| 6,887,102 | B1 | 5/2005 | Burris et al. |
| 6,971,912 | B2 | 12/2005 | Montena et al. |
| 7,014,501 | B2 | 3/2006 | Montena |
| 7,029,304 | B2 | 4/2006 | Montena |
| 7,059,900 | B2 | 6/2006 | Holliday |
| 7,097,500 | B2 | 8/2006 | Montena |
| 7,128,603 | B2 | 10/2006 | Burris et al. |
| 7,147,509 | B1 | 12/2006 | Burris et al. |
| 7,163,420 | B2 | 1/2007 | Montena |
| 7,181,999 | B1 | 2/2007 | Skeels et al. |
| 7,226,300 | B2 | 6/2007 | Khemakhem |
| 7,311,555 | B1 | 12/2007 | Burris et al. |
| 7,329,149 | B2 | 2/2008 | Montena |
| 7,341,129 | B2 | 3/2008 | Hsieh |
| 7,347,129 | B1 | 3/2008 | Youtsey |
| 7,364,462 | B2 | 4/2008 | Holland |
| 7,544,094 | B1 | 6/2009 | Paglia et al. |
| 7,618,276 | B2 | 11/2009 | Paglia et al. |
| 7,727,011 | B2 | 6/2010 | Montena et al. |
| 7,780,386 | B2 | 8/2010 | Lau et al. |
| 7,798,849 | B2 | 9/2010 | Montena |
| 7,837,501 | B2 | 11/2010 | Youtsey |
| 7,874,871 | B2 | 1/2011 | Montena |
| 7,892,005 | B2 | 2/2011 | Haube |
| 7,946,199 | B2 | 5/2011 | Bradley |
| 7,997,930 | B2 | 8/2011 | Ehret et al. |
| 8,016,605 | B2 | 9/2011 | Montena et al. |
| 8,016,612 | B2 | 9/2011 | Burris et al. |
| 8,065,940 | B2 | 11/2011 | Wilson et al. |
| 8,287,310 | B2 | 10/2012 | Burris et al. |
| 8,342,879 | B2 | 1/2013 | Amidon et al. |
| 8,444,445 | B2 | 5/2013 | Amidon et al. |
| 8,465,322 | B2 | 6/2013 | Purdy |
| 8,490,525 | B2 | 7/2013 | Wilson et al. |
| 8,568,164 | B2 | 10/2013 | Ehret et al. |
| 8,568,167 | B2 | 10/2013 | Montena |
| 8,882,520 | B2 | 11/2014 | Youtsey |
| 8,944,837 | B2 | 2/2015 | Huang |
| 9,028,276 | B2 | 5/2015 | Wilson et al. |
| 9,048,599 | B2 | 6/2015 | Burris |
| 9,124,046 | B2 | 9/2015 | Ehret et al. |
| 9,153,917 | B2 | 10/2015 | Purdy |
| 9,172,181 | B2 | 10/2015 | Huang |
| D743,891 | S | 11/2015 | Shaw et al. |
| 9,240,636 | B2 | 1/2016 | Youtsey |
| 2002/0013088 | A1 | 1/2002 | Rodrigues et al. |
| 2004/0194585 | A1 | 10/2004 | Clark |
| 2004/0231126 | A1 | 11/2004 | Louwagie et al. |
| 2005/0020129 | A1 | 1/2005 | Dykstra et al. |
| 2006/0213059 | A1 | 9/2006 | Eggert |
| 2010/0199813 | A1 | 8/2010 | Phillips et al. |
| 2015/0295368 | A1 | 10/2015 | Wilson et al. |
| 2015/0325932 | A1 | 11/2015 | Ehret et al. |
| 2016/0181742 | A1 | 6/2016 | Wilson et al. |
| 2017/0365949 | A1 | 12/2017 | Montena et al. |

CONNECTOR ASSEMBLY WITH TORQUE SLEEVE

RELATED APPLICATION

The present application is a continuation-in-part of U.S. application Ser. No. 15/254,360 filed on Sep. 1, 2016 and entitled Connector Assembly With Torque Sleeve, the subject matter of which is herein incorporated by reference.

FIELD OF THE INVENTION

The present invention relates to a connector assembly with a torque sleeve that facilitates attachment of the connector assembly to a mating connector, port or equipment while also preventing the potential damaging impact of overtightening the connector assembly, mating connector, port, or equipment.

BACKGROUND OF THE INVENTION

Coaxial cable connectors are typically used to connect a coaxial cable with a mating connector, port or terminal of another device, such as equipment, appliances, and the like. Proper tightening of the connector is required to maintain an electrical connection and maximize electrical performance. Overtightening of the connector, however, may result in damage to the connector and/or its mating connector or port and not providing optimum electrical performance. Also current coaxial connectors are typically designed for using the same torque when both tightening and loosening the connector, which results in wear out of the mating components over time.

Therefore, a need exists for connector assembly that facilitates proper tightening of the connector while also preventing potentially damaging overtightening of the connector and has a loosening torque that is higher than the tightening torque to reduce wear on the connector components.

SUMMARY OF THE INVENTION

Accordingly, the present invention may provide a connector assembly comprising a connector that includes a coupling member rotatably coupled to a body, and the coupling member has an interface end configured to engage a mating connector, port, or equipment. A gripping sleeve receives at least a portion of the body in a rear end thereof and at least a portion of the coupling member in a front end thereof. A torque limiting feature includes a slip element that is located at or near the front end of the gripping sleeve and an engaging element that is located on the coupling member. The slip element and the engaging element engage one another such that rotation of the gripping sleeve applies torque to and rotates the coupling member in a tightening direction until a predetermined torque limit is reached when the slip element disengages from the engaging element allowing the gripping sleeve to rotate with respect to the coupling member such that no additional torque is applied to the coupling member by the gripping sleeve beyond the predetermined torque limit. In a certain embodiment, the torque limiting feature applies a first torque force when the slip element and the engagement element engage one another to rotate the coupling member in the tightening direction and applies a second torque force when the slip element and the engagement element engage one another to rotate the coupling member in the loosening direction, and the second torque force is larger than the first torque force The present invention may also provide a connector assembly comprising a connector that includes a coupling member rotatably coupled to a body, and the coupling member has an interface end configured to engage a mating connector. A gripping sleeve has a rear end that receives at least a portion of the body and has a front end that receives at least a portion of the coupling member. A torque limiting feature includes a slip element that is located on an inner surface of the gripping sleeve and an engaging element that is located on an outer surface of the coupling member. The slip element and the engaging element engage one another such that rotation of the gripping sleeve applies torque to and rotates the coupling member in a tightening direction until a predetermined torque limit is reached when the slip element disengages from the engaging element allowing the gripping sleeve to rotate with respect to the coupling member such that no additional torque is applied to the coupling member by the gripping sleeve beyond the predetermined torque limit.

The present invention may yet further provide a connector assembly comprising a connector that includes a coupling member rotatably coupled to a body, and the coupling member has an interface end configured to engage a mating connector. A gripping sleeve that has a rear end that receives at least a portion of the body and a front end that receives at least a portion of the coupling member. The gripping sleeve is configured to apply torque to the coupling member. The connector assembly also including a means for limiting torque applied to the coupling member by the gripping sleeve such that the gripping sleeve applies torque to and rotates the coupling member in a tightening direction until a predetermined torque limit is reached allowing the gripping sleeve to rotate with respect to the coupling member such that no additional torque is applied to the coupling member by the gripping sleeve beyond the predetermined torque limit.

The present invention may further provided a connector assembly that comprises a connector including a coupling member rotatably coupled to a body and has an interface end configured to engage a mating connector; a gripping sleeve having a rear end that receives at least a portion of the body and a front end that receives at least a portion of the coupling member; and a torque limiting feature including at least one slip element associated with the front end of the gripping sleeve and at least one engaging element associated with the coupling member. The torque limiting feature preferably has first and second predetermined torque limits where the second predetermined torque limit is greater than the first predetermined torque limit. The slip element and the engaging element engage one another such that rotation of the gripping sleeve applies torque to and rotates the coupling member in a tightening direction until the first predetermined torque limit is reached when the slip element disengages from the engaging element thereby allowing the gripping sleeve to rotate with respect to the coupling member in the tightening direction such that no additional torque is applied to the coupling member by the gripping sleeve that is greater than the first predetermined torque limit. The gripping sleeve rotates with respect to coupling member in a loosening direction that is opposite the tightening direction until the second predetermined torque limit is reached when the slip element re-engages the engaging element allowing the gripping sleeve to rotate the coupling member in the loosening direction.

In certain embodiments, the slip element is a spring finger extending inwardly toward the coupling member and the engaging element is a protrusion extending outwardly from an outer surface of the coupling member; the first predetermined torque limit is at least partially based on a thickness of the spring finger and a depth dimension of the spring finger; the value of the first predetermined torque limit is based on a height of the protrusion; the protrusion includes a sloped surface and a normal surface, and the spring finger engages the sloped surface when rotating the gripping sleeve and the coupling member in the tightening direction and engages the normal surface when rotating the gripping sleeve and the coupling member in the loosening direction; and the sloped and normal surfaces may be substantially flat or include a rounded face. In some embodiments, the spring finger extends from a spring that generally surrounds the coupling member; the spring finger extends from an inner surface of the gripping sleeve spring and may be integral with that inner surface; a plurality of spring fingers extend from the inner surface of the gripping sleeve and at least two of the spring fingers have different depth dimensions; the slip element is a spring that generally surrounds the coupling member and has a substantially wave shape with at least one concave contact point for engaging the engaging element; a value of the first predetermined torque limit is at least partially based on a depth of the at least one concave contact point and a thickness of the spring. In one embodiment, the protrusion or protrusions are integrally formed with the coupling member.

The present invention may yet further provide a connector assembly that comprises a connector including a coupling member rotatably coupled to a body and has an interface end configured to engage a mating connector; a gripping sleeve having a rear end that receives at least a portion of the body and a front end that receives at least a portion of the coupling member; and a torque limiting feature including at least one slip element associated with the front end of the gripping sleeve and at least one engaging element associated with the coupling member. The torque limiting feature preferably has first and second predetermined torque limits where the second predetermined torque limit is greater than the first predetermined torque limit. The slip element tangentially engages the engaging element such that rotation of the gripping sleeve applies torque to and rotates the coupling member in a tightening direction until the first predetermined torque limit is reached when the slip element disengages from the engaging element thereby allowing the gripping sleeve to rotate with respect to the coupling member in the tightening direction such that no additional torque is applied to the coupling member by the gripping sleeve that is greater than the first predetermined torque limit. The gripping sleeve rotates with respect to the coupling member in a loosening direction that is opposite the tightening direction until the second predetermined torque limit is reached allowing the gripping sleeve to rotate the coupling member in the loosening direction.

In certain embodiments, the at least one slip element is a spring finger that extends inwardly toward the coupling member and the at least one engaging element is a protrusion that extends outwardly from an outer surface of the coupling member; the first predetermined torque limit is based on a thickness of the spring finger, a depth dimension of the spring finger, and a height of the protrusion; the protrusion includes a sloped surface that provides the tangential engagement with the spring finger and a normal surface that provides the radial engagement with the spring finger; and the slip element is a plurality of annularly spaced spring fingers that extend inwardly toward the coupling member and the engaging element is a plurality of annularly spaced protrusions that extend outwardly from an outer surface of the coupling member.

The present invention may still further provide a connector assembly that comprises a connector including a coupling member rotatably coupled to a body and has an interface end configured to engage a mating connector; a gripping sleeve having a rear end that receives at least a portion of the body and a front end that receives at least a portion of the coupling member, the gripping sleeve being configured to apply torque to the coupling member; and means for limiting torque applied to the coupling member by the gripping sleeve in both a tightening direction and a loosening direction such that the gripping sleeve applies torque to and rotates the coupling member in the tightening direction until a first predetermined torque limit is reached allowing the gripping sleeve to rotate with respect to the coupling member such that no additional torque is applied to the coupling member by the gripping sleeve beyond the first predetermined torque limit, and such that the gripping element rotates with respect to the coupling member in the loosening direction opposite the tightening direction until the second predetermined torque limit is reached allowing the gripping sleeve to apply torque to and rotate the coupling member in the loosening direction.

In a preferred embodiment, the means for limiting torque applies a first torque force when rotating the coupling member in the tightening direction and applies a second torque force when rotating the coupling member in the loosening direction, and the second torque force is larger than the first torque force.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawing figures.

DETAILED DESCRIPTION OF THE INVENTION

Figure 1:
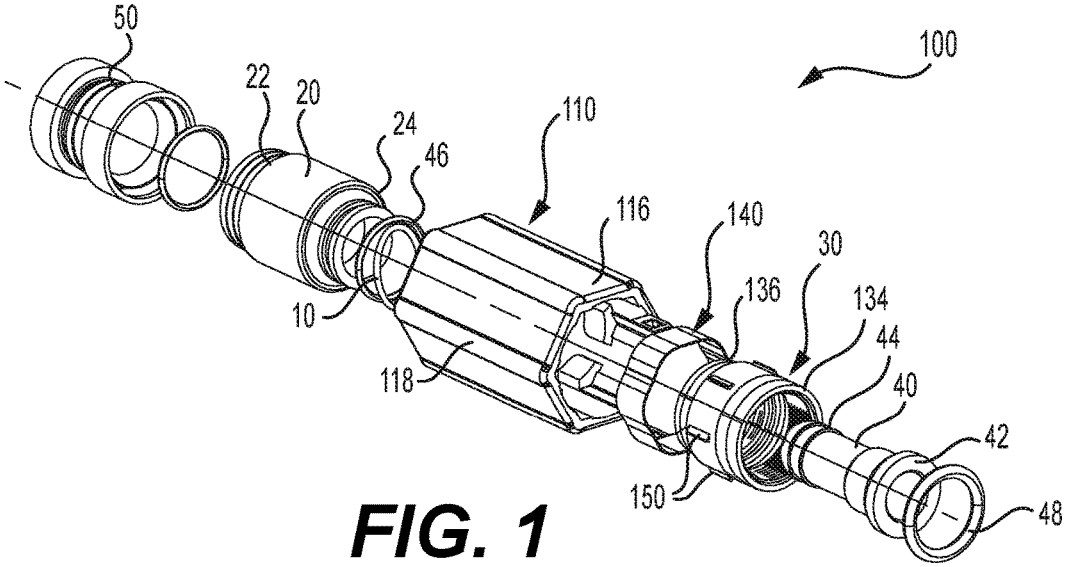
FIG. 1 is an exploded perspective view of a connector assembly according to a first exemplary embodiment of the present invention.

Referring to FIGS. 1-16C, the present invention relates to exemplary embodiments of a connector assembly 100, 200, 300, 400, 500, and 600 that includes a connector, such as a coaxial connector, and a sleeve coupled to the connector. The sleeve is designed to facilitate gripping and application of torque to the connector in both the tightening and loosening directions. A torque limiting feature of the present invention limits the amount of torque applied to the connector in the tightening direction to prevent overtightening and prevents accidental loosening of the connector by applying an increased torque limit when the connector is rotated in the loosening direction.

The connector of each embodiment of the connector assembly 100, 200, 300, 400, 500, and 600 includes a connector body 20, a coupling member 30, and a post member 40. A compression member 50 may be provided to facilitate termination of the cable with the connector assembly. A grounding member 10 may be provided that is disposed on the outside of the connector body 20 to maintain electrical contact between the coupling member 30 and the connector body 20, thereby even if the connection between the connector assembly 100, 200, 300, 400, 500, or 600 and its mating connector or port becomes loose, as described in commonly assigned U.S. Pat. No. 8,231,412 entitled Electrical Connector With Grounding Member, herein incorporated by reference.

The post member 40 has a substantially tubular shape with an enlarged shoulder end 42 that couples with the coupling member 30, and an opposite end 44 designed to interface with a prepared end of a coaxial cable (not shown), as is well known in the art. The post member 40 is received in both the connector body 20 and the coupling member 30, such that the coupling member 30 rotates with respect to the post member 40 and the connector body 20. The connector body 20 is generally tubular in shape with a first end 22 adapted to couple with the prepared end of the cable, as is well known in the art, and an opposite second end 24 that engages the post member 40. An O-ring 46 may be provided between the coupling member 30 and the second end 24 of the connector body 20 and on compression member 50 to prevent moisture migration.

Figure 2:
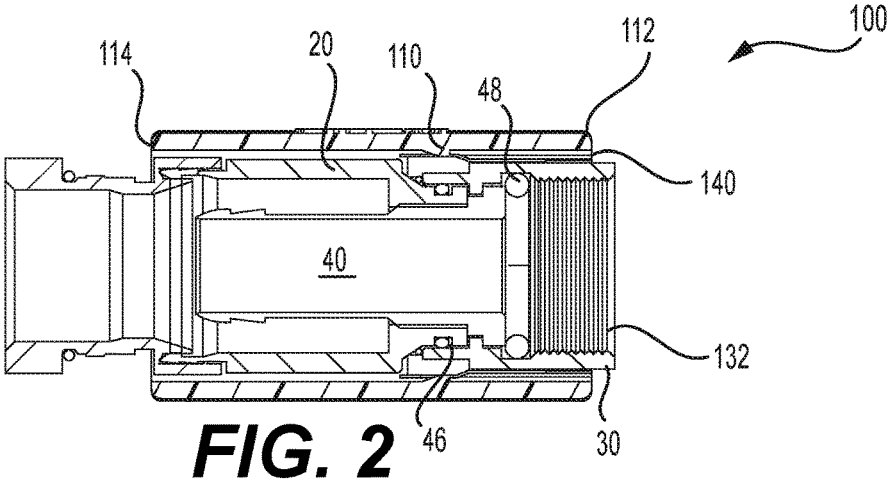
FIG. 2 is cross-sectional view of the connector assembly illustrated in FIG. 1.
Figure 3A:
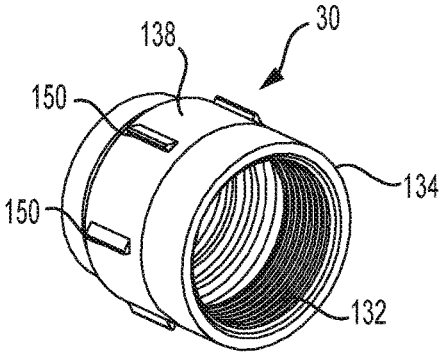
FIGS. 3A-C are various views of a coupling member of the connector assembly illustrated in FIG. 1.

FIGS. 1, 2, 3A-3C, 4A-4C, 5A, and 5B illustrate a first exemplary embodiment of a connector assembly 100 of the present invention. The coupling member 30 of connector assembly 100 is preferably substantially circular or hexagonal in cross-section and may include internal threads 132, as best seen in FIG. 3A, for engaging corresponding external threads of a mating connector or port. The coupling member 30 includes an interface end 134 which engages the mating connector and an opposite free end 136 that catches the enlarged shoulder end 42 of the post member 40, thereby rotatably coupling the coupling member 30 to the post member 40. An O-ring 48 is preferably provided inside of the coupling member 30 to prevent moisture migration.

A gripping sleeve 110 surrounds the connector such that at least a portion of the coupling member 30 is received in a front end 112 of sleeve 110 and at least a portion of the body 20 is received in a rear end 114, as seen in FIG. 2. Sleeve 110 includes an outer surface 116 that may be configured to facilitate gripping of sleeve 110. In a preferred embodiment, outer surface 116 has a substantially hexagonal shape and includes one or more longitudinal extensions 118. The inner surface 120 may include an inwardly extending retaining flange 122 configured to retain sleeve 110 on the connector, as described in commonly assigned U.S. Pat. No. 7,544,094 entitled Connector Assembly With Gripping Sleeve, the subject matter of which is herein incorporated by reference.

Connector assembly 100 incorporates a torque limiting feature that includes a slip element 140 which cooperates with one or more engaging elements 150. Slip element 140 is preferably disposed on inner surface 120 of sleeve 110 near its front end 112. The one or more engaging elements 150 are preferably disposed on an outer surface 138 of coupling member 30. The slip element 140 and the one or more engaging elements 150 engage one another such that rotation of sleeve 110 applies torque to and rotates coupling member 30 in a tightening direction, that is in a direction to tighten coupling member 30 on a mating connector or port, until a predetermined torque limit is reached when the slip element 140 will flex and disengage from the one or more engaging elements 150 allowing sleeve 110 to rotate with respect to the coupling member 30 such that no additional torque is applied to the coupling member 30 by the sleeve 110. Gripping sleeve 110 may also apply torque to coupling member 30 when rotated in the loosening direction to facilitate loosening of coupling member 30.

Figure 5A:
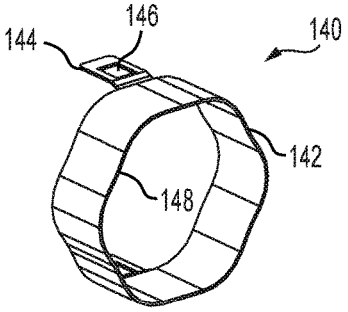
FIGS. 5A and 5B are perspective and end views of a slip element of the connector assembly illustrated in FIG. 1.
Figure 5B:
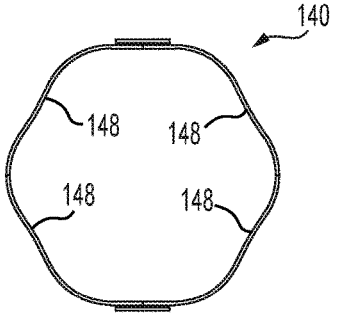
Figure 6:
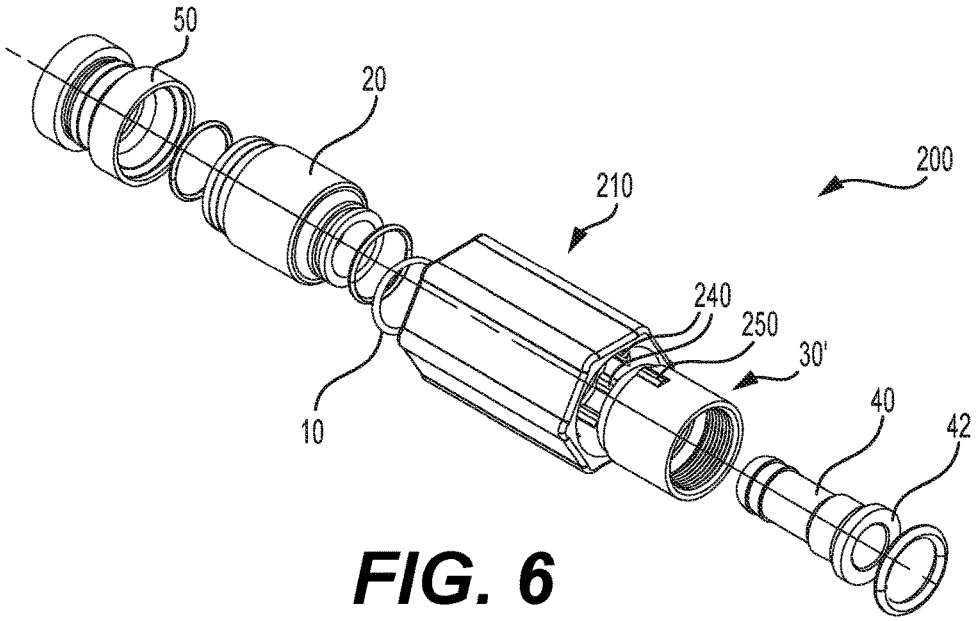
FIG. 6 is an exploded perspective view of a connector assembly according to a second exemplary embodiment of the present invention.
Figure 7:
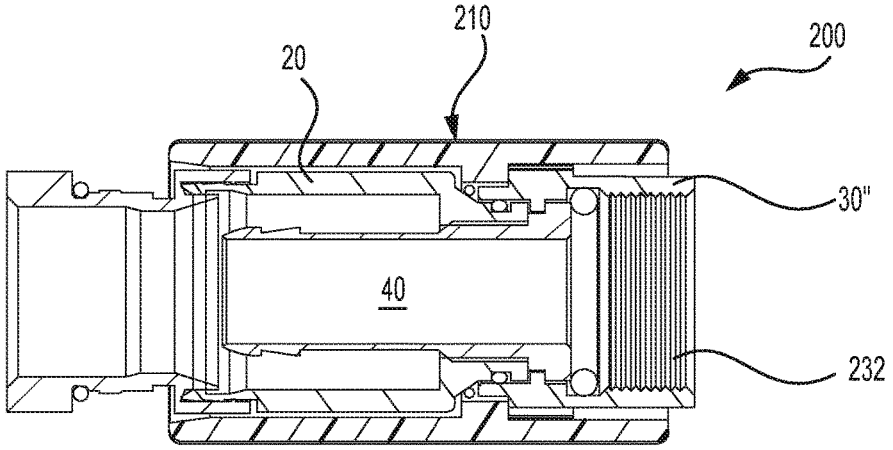
FIG. 7 is a cross-sectional view of the connector assembly illustrated in FIG. 6.

As best seen in FIGS. 1, 5A, and 5B, slip element 140 is preferably a spring that generally has a ring 142. The slip element 140 may be formed of stamped metal. The slip element 140 is preferably separate from sleeve 110 but rests on the sleeve's inner surface 120 positioned against one or more spaced abutments 124 extending from inner surface 120. One or more retaining features 144 may be provided on slip element 140 that correspond to one or more retaining features 126 located on inner surface 120 of sleeve 110, where the retaining features 126 and 144 engage one another for retaining slip element 140 inside sleeve 110. The one more retaining features 126 may be, for example, a detent (FIG. 4C) on the sleeve's inner surface 120 and the one or more retaining features 144 may be, for example, a tab having an opening 146 (FIG. 5A) which receives the detent of sleeve 110.

Slip element or spring 140 may have a substantially wave shape where concave portions thereof define contact points 148 (FIGS. 5A and 5B) for engaging the engaging elements 150 of coupling member 30. In a preferred embodiment, slip element 140 includes four contact points 148; however any number of contact points 148 may be provided including a single contact point 148.

Figure 3B:
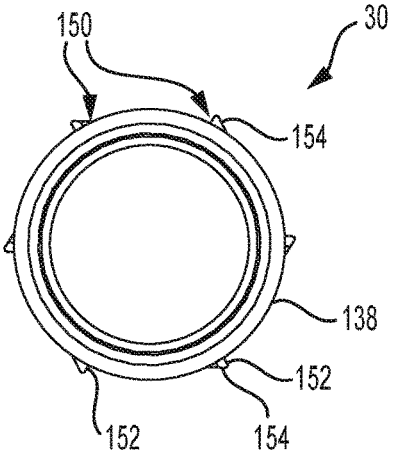
Figure 3C:
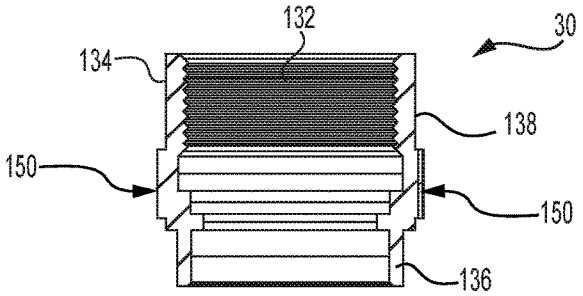
Figure 4A:
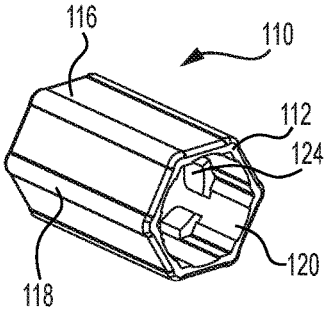
FIGS. 4A-C are various views of a gripping sleeve of the connector assembly illustrated in FIG. 1.
Figure 4B:
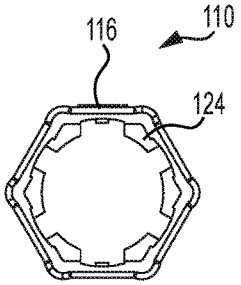
Figure 4C:
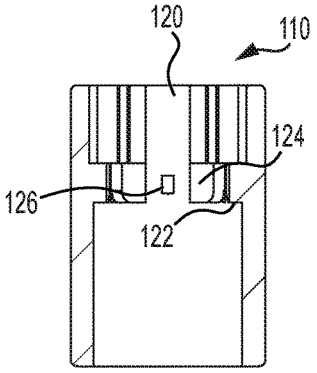

The one more engaging elements 150 may be one or more protrusions which extend from the coupling member's outer surface 138. Each engaging element or protrusion may be positioned longitudinally on outer surface 138 of coupling member 30. Each engaging element or protrusion 150 may include a normal surface 152 and a sloped surface 154 extending away from normal surface 152, as best seen in FIG. 3B. Sloped surface 154 faces away from the tightening direction. The engagement elements or protrusions 150 are preferably annularly and uniformly spaced around the coupling member's outer surface 138. The protrusions 150 may be formed integrally with the coupling member to form a one-piece unitary component.

Each engaging element 150 is designed to engage the one or more contact points 148 such that when sleeve 110 is rotated in the tightening direction, the coupling member 30 also rotates in the tightening direction until the selected and predetermined torque limit is reached to prevent overtightening. That is, once coupling member 30 is sufficiently tightened on a mating connector or port, slip element 140 of sleeve 110 will slip over the engaging elements 150 of coupling member 30 such that sleeve 110 no longer applies any torque to coupling member. More specifically, the flexible and spring nature of slip element 140 allows the concave contact points 148 thereof to slip over the sloped surfaces 154 of the engaging elements or protrusions 150 when the predetermined torque limit is reached so that sleeve 110 no longer rotates the coupling member 30. This slipping action can create a clicking sound thereby alerting the user that the overtightening torque limit has been reached and the coupling member 30 is sufficiently tight. The value of the predetermined torque limit may be selected, changed or adjusted by changing the depth of the concave contact points 148 into sleeve 110 and/or by changing the thickness of the ring of slip element 140. For example, the deeper the concave contact points 148 is and the thicker the slip element 140 is provides greater resistance when engaging the engaging elements 150 and thus a higher predetermined torque limit value.

The depth of the contact portions 148 and thickness of spring 140 along with the configuration of the normal and sloped surfaces 152 and 154 of each protrusion 150 preferably provide two predetermined torque limits for the torque limiting feature of the present invention. Sloped surface 154 allows the contact points 148 of slip element 140 to tangentially engage the protrusions 150 so that the gripping sleeve 110 can rotate the coupling member 30 in its tightening direction (to the left in FIG. 3B) until a first predetermined torque limit is reached when the slip element 140 disengages from or rides over the sloped surfaces 154 of the protrusions 150, thereby preventing overtightening onto the mating connector. Normal surface 152 generally prevents rotation of gripping element 110 and coupling member 30 in the opposite loosening direction when the contact points 148 of slip element 140 radially engage normal surfaces 152, such as by abutting the normal surface 152, to maintain a secure connection with the mating connector. To release the connector assembly 100 from its mating connector, gripping sleeve 110 may be rotated with respect to coupling member 30 in the loosening direction until a second predetermined limit is reached when the contact points 148 deform and ride over the protrusions 150 and re-engage the sloped surfaces 154 thereof thereby allowing the gripping sleeve to rotate the coupling member 30 in the loosening direction. To prevent premature or accidental loosening of the coupling nut 30, the second predetermined torque limit is preferably greater than the first predetermined torque limit. In one embodiment, the first predetermined torque limit is less than or equal to about 3 in/lbs and the second predetermined torque limit is at least 4 in/lbs or greater.

FIGS. 6, 7, 8A-8C, and 9A-9C illustrate a second exemplary embodiment of a connector assembly 200 according to the present invention. Connector assembly 200 of the second embodiment is similar to the first embodiment, except that the slip element 240 of the second embodiment is not separate from the sleeve 210 and preferably includes one or more ribs 242 extending from the sleeve's inner surface 220. Ribs 242 may be annularly spaced around the inner surface 220 of sleeve 210 and located adjacent to the inner retaining flange 122. Each rib 242 preferably extends longitudinally inside sleeve 210.

Figure 8A:
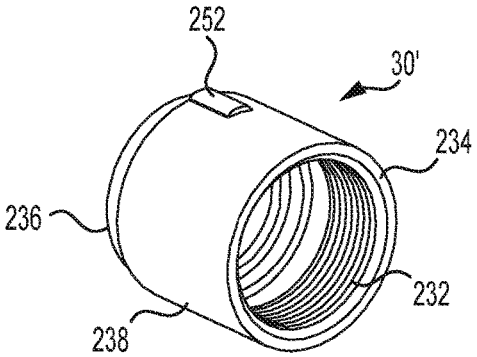
FIGS. 8A-8C are various view of a coupling member of the connector assembly illustrated in FIG. 6.
Figure 8B:
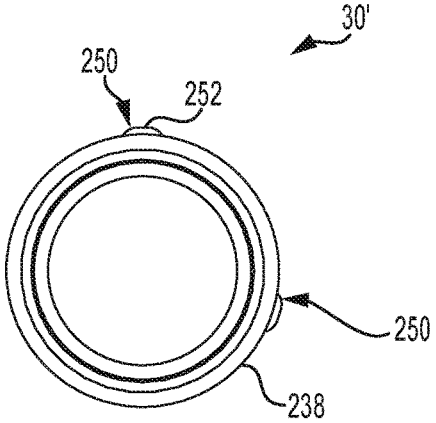
Figure 8C:
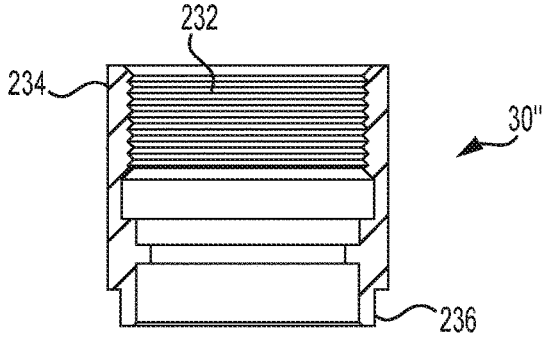
Figure 9A:
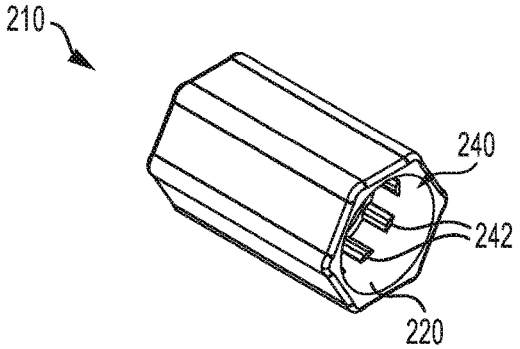
FIGS. 9A-9C are various views of a gripping sleeve of the connector assembly illustrated in FIG. 6.
Figure 9B:
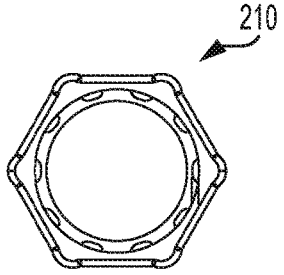
Figure 9C:
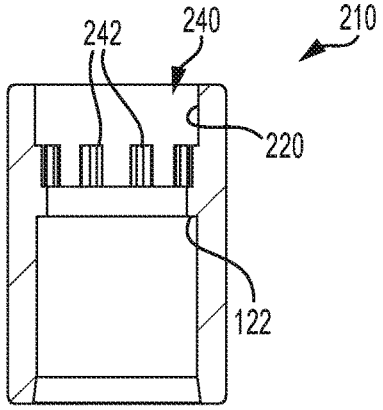
Figure 10:
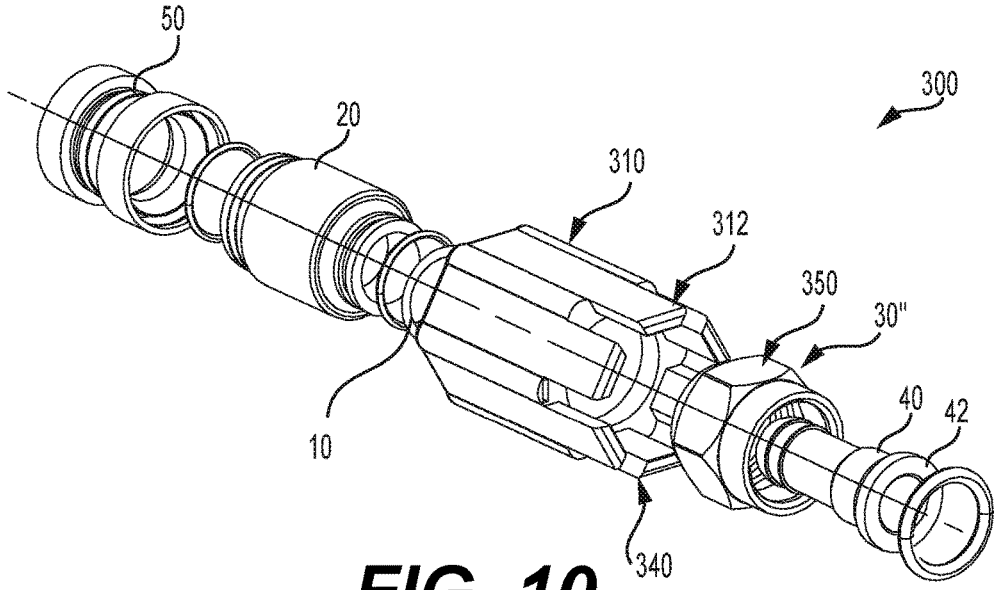
FIG. 10 is an exploded perspective view of a connector assembly according to a third exemplary embodiment of the present invention.

The coupling member 30' of connector assembly 200 is similar to the coupling member 30 of the first embodiment, except that the engaging elements or protrusions 250 of coupling member 30' preferably have a different more rounded shape than the engaging elements or protrusions 150 of the first embodiment and includes a rounded face 252. The coupling member 30' is substantially circular in cross-section, as seen in FIG. 8B, and may include internal threads 232, as best seen in FIG. 8A, for engaging corresponding external threads of a mating connector or port. The coupling member 30' includes an interface end 234 which engages the mating connector and an opposite free end 236 that catches the enlarged shoulder end 42 of the post member 40, thereby rotatably coupling the coupling member 30 to the post member 40. In a preferred embodiment, two spaced engaging elements 250 are provided on the outer surface 238 of coupling member 30' and are located closer to the free end 236 of coupling member 30' than the interface end 234. However, any number of engaging elements 250 may be provided including a single engaging element. In a preferred embodiment, the engaging elements 250 are spaced further apart from one another than the spacing between the ribs 242.

Each engaging element 250 is designed to engage the one or more of the ribs 242 when sleeve 210 is rotated in the tightening direction, the coupling member 30' also rotates in the tightening direction until the selected and predetermined torque limit is reached to prevent overtightening. Once coupling member 30' is sufficiently tightened on a mating connector or port, the one or more ribs 242 of slip element 240 of sleeve 210 will slip over the rounded faces 252 of the engaging elements 250 of coupling member 30' such that sleeve 210 no longer applies any more torque than the predetermined torque to coupling member. Similar to the first embodiment, this slipping action can create a clicking sound thereby alerting the user that the torque limit has been reached and the coupling member 30' is sufficiently tight. The value of the predetermined torque limit may be selected, changed or adjusted by changing the height/depth and/or of the ribs 242 on sleeve 210 and/or changing the height and/or shape of the engaging elements 250 on coupling member 30'. For example, the greater the height or depth of the ribs 242 and/or the engaging elements 250, the greater the resistance is when the slip element 240 engages the engaging elements 250, thereby resulting in a higher predetermined torque limit value. Gripping sleeve 210 may also apply torque to coupling member 30' when rotated in the loosening direction to facilitate loosening of coupling member 30'.

Similar to the first embodiment, the ribs 242 and engaging elements 250 may be designed such that two predetermined torque limits are provided for the tightening and loosening directions. When tightening, ribs 242 engage the engaging element 250 so that the gripping sleeve 210 can rotate the coupling member 30' in the tightening direction until a first predetermined torque limit is reached when the ribs 242 ride over and disengage from the engaging elements 250, thereby preventing overtightening onto the mating connector. Gripping sleeve 110 may then be rotated with respect to coupling member 30' in the loosening direction until a second increased predetermined limit is reached when the ribs 242 ride over the elements 250 and re-engage the coupling member 30', to allow the gripping sleeve to rotate the coupling member 30' in the loosening direction to release the connector.

FIGS. 10-12 and 13A-13C illustrate a third exemplary embodiment of the connector assembly 300 in accordance with the present invention. Connector assembly 300 is similar to the first and second embodiments in that it includes a sleeve 310 that slips over the coupling member 30" when a predetermined torque limit is reached. Sleeve 310 includes slip element 340 which comprises one or more flexible fingers 342 extending from the front end 312 of sleeve 310. The one or more flexible fingers 342 are preferably spaced from one another by a slot 344. Each finger 342 may include a substantially flat inner surface portion 346 for engaging coupling member 30".

Figure 11:
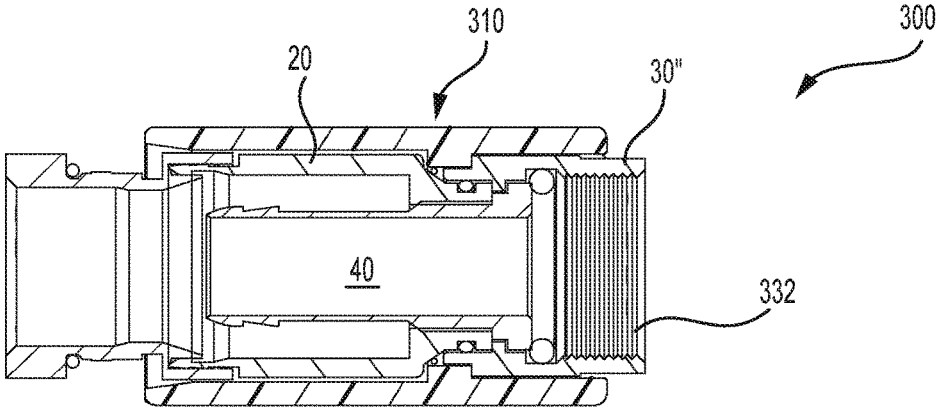
FIG. 11 is a cross-sectional view of the connector assembly illustrated in FIG. 10.
Figure 12:
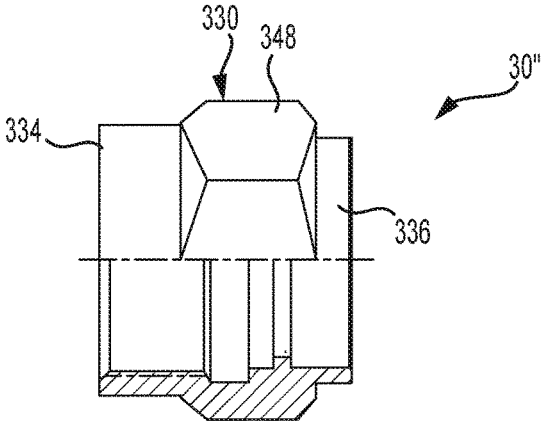
FIG. 12 is an elevational view of a coupling member of the connector assembly illustrated in FIG. 10.
Figure 13A:
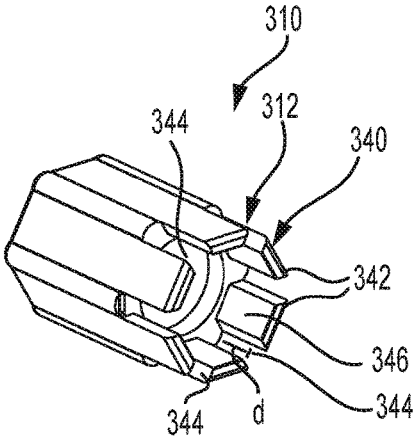
FIGS. 13A-13C are various views of a gripping sleeve of the connector assembly illustrated in FIG. 10.
Figure 13B:
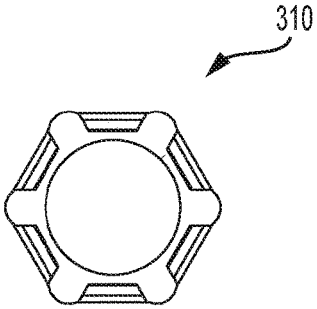
Figure 13C:
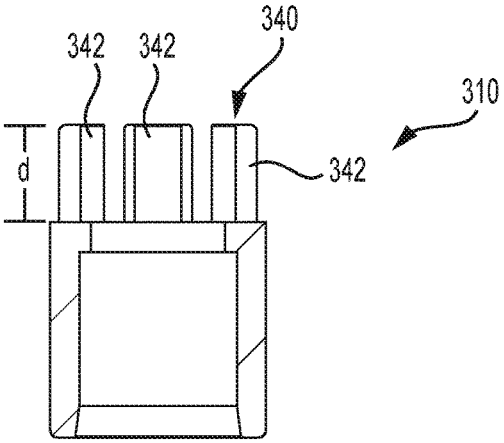

Coupling member 30" preferably has a substantially hexagonally shaped portion 330, as seen in FIG. 12, and may include internal threads 332, as best seen in FIG. 11, for engaging corresponding external threads of a mating connector or port. The coupling member 30" includes an interface end 334 which engages the mating connector and an opposite free end 336 that catches the enlarged shoulder end 42 of the post member 40, thereby rotatably coupling the coupling member 30 to the post member 40. The hexagonally shaped portion 330 includes engaging elements 350 adapted to frictionally engage the one or more flexible fingers 342 of sleeve 310. Each engaging element 350 preferably comprises a substantially flat portion 348 on the outer surface of the hexagonally shaped portion of coupling member 30".

Each substantially flat portion 348 of coupling member 30" is designed to engage a corresponding substantially flat inner surface portion 346 of the one more flexible fingers 342 of sleeve 310 such that when sleeve 310 is rotated in the tightening direction, the coupling member 30" also rotates in the tightening direction until the selected and predetermined torque limit is reached. Once coupling member 30" is sufficiently tightened on a mating connector or port, the one or more flexible fingers 342 of slip element 340 of sleeve 310 will slip over the substantially flat portions 348 of coupling member 30" such that sleeve 310 no longer applies any torque to coupling member. Gripping sleeve 310 may also apply torque to coupling member 30" when rotated in the loosening direction to facilitate loosening of coupling member 30".

The value of the predetermined torque limit for connector assembly 300 may be selected, changed or adjusted by changing the depth d of the slots 344 between the one or more fingers 342. The depth d of the slots 344 may be measured from an end face 349 at the front end 312 of sleeve 310. For example, the greater the depth d of slots 344, the more flexible the fingers 342 are, thereby allowing the fingers 342 to more easily slip over the hexagonally shaped portion 330 of coupling member 30", resulting in a lower value for the predetermined torque limit.

Figure 14A:
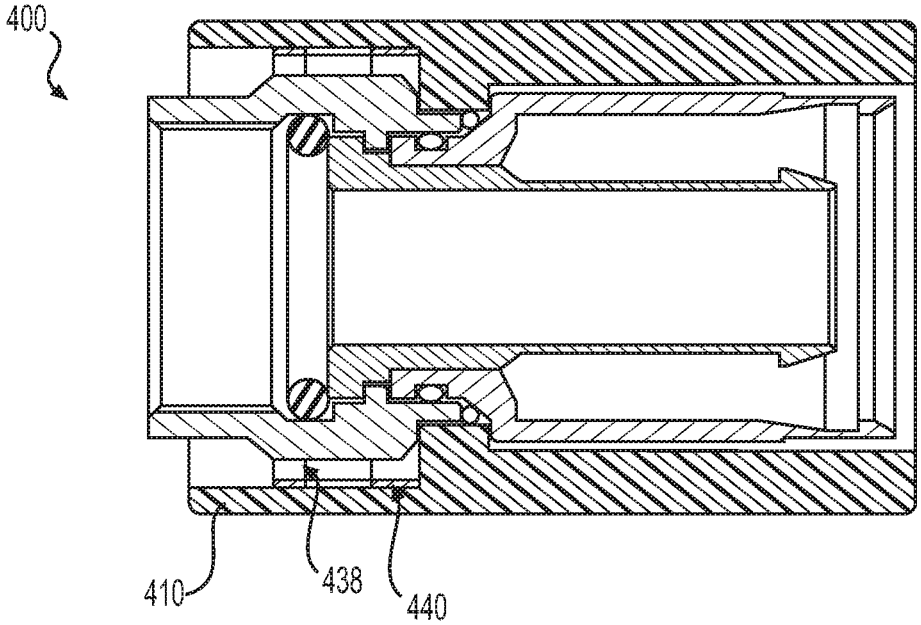
FIGS. 14A and 14B are cross-sectional and front end views, respectively, of a connector assembly, according to a fourth exemplary embodiment of the present invention.
Figure 14C:
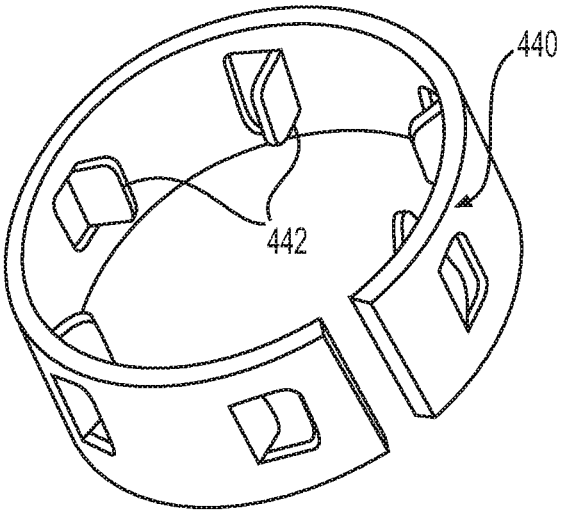
FIG. 14 C is a perspective view of a slip element of the connector assembly illustrated in FIG. 14A.
Figure 14B:
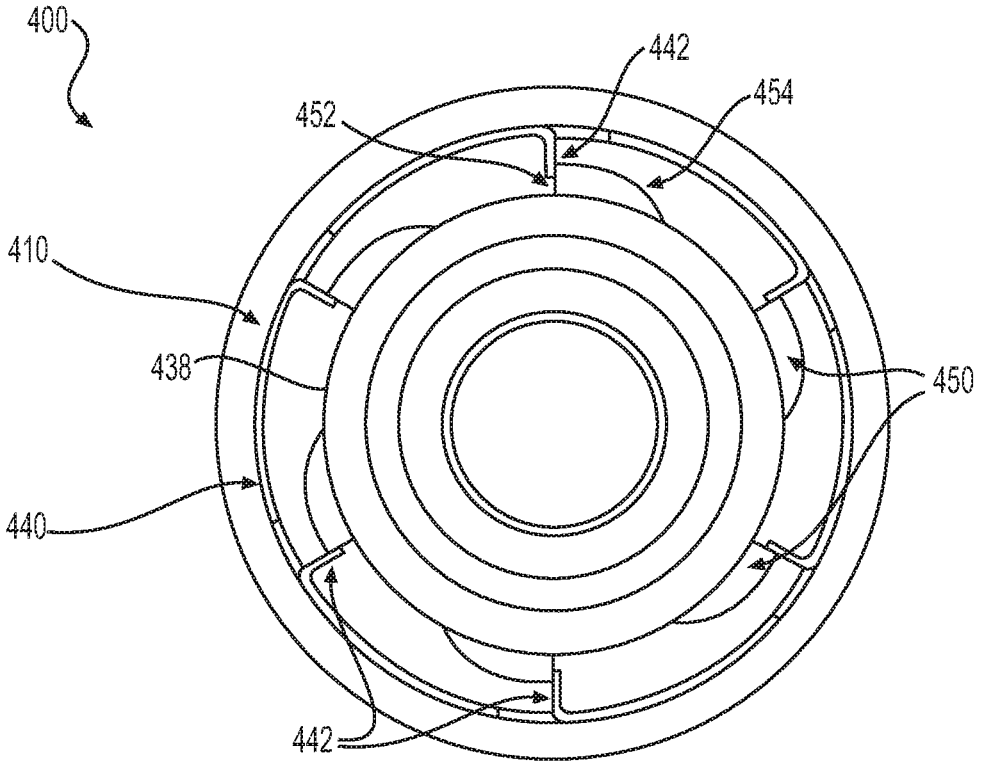

FIGS. 14A-14C illustrate a fourth exemplary embodiment of a connector assembly 400 according to the present invention. Connector assembly 400 of the fourth embodiment is similar to the first embodiment wherein the slip element 440 is a spring that generally surrounds the coupling member, except that the spring slip element 440 includes one or more inwardly extending spring fingers 442 that engage the one or more protrusions 450 of the coupling member. Spring fingers 442 may be annularly spaced around the spring 440.

Each engaging element or protrusion 450 may include a normal surface 452 and a generally sloped surface 454 extending away from normal surface 452, as best seen in FIG. 14B. Sloped surface 454 may be substantially flat or have a rounded face. Sloped surface 454 generally slopes inward away from the tightening direction. Normal surface 452 is preferably substantially flat. The engagement elements or protrusions 450 are preferably annularly and uniformly spaced around the coupling member's outer surface 438. Each engaging element 450 is designed to engage the one or more spring fingers 442, that is each spring finger 442 tangentially engages the sloped surfaces 454 of each protrusion 450, such that when sleeve 410 is rotated in the tightening direction, the coupling member also rotates in the tightening direction until the selected and predetermined torque limit is reached to prevent overtightening similar to the above embodiments. The flexible and spring nature of springs member 442 allows the spring fingers 442 to slip over the sloped surfaces 454 of the engaging elements or protrusions 450 when the predetermined torque limit is reached so that sleeve 410 no longer rotates the coupling member. The value of this predetermined torque limit may be selected, changed or adjusted by changing the depth dimension of the spring fingers 442, by changing the thickness of the spring 440, and/or changing the height of the protrusions 450.

Like the embodiments above, the torque limiting feature of the fourth embodiment may include two predetermined torque limits for the tightening and loosening directions, respectively, where the predetermined torque limit for the loosening direction is greater than the predetermined torque limit for the tightening direction. The depth of the spring fingers 442 and thickness of spring 440 along with the configuration of the normal and sloped surfaces 452 and 454 of each protrusion 450 preferably provide the two predetermined torque limits. Sloped surfaces 454 allow the spring fingers 442 to tangentially engage the protrusions 450 so that the gripping sleeve 410 can rotate the coupling member in its tightening direction until the first predetermined torque limit is reached when the slip element 440 disengages from or rides over the sloped surfaces 454, as seen in FIG. 14B, thereby preventing overtightening onto the mating connector. Gripping sleeve 410 may then be rotated with respect to coupling member in the loosening direction until the second predetermined limit is reached when the spring fingers 442 deform and ride over the protrusions 450 and re-engage the sloped surfaces 454 thereof, thereby allowing the gripping sleeve to rotate the coupling member in the loosening direction. When rotating in the reverse/loosening direction, surfaces 452 and fingers 442 are initially against each other, as seen in FIG. 14B, and create a larger torque force in the loosening direction than those surfaces create during rotation in the tightening direction, even after many number of cycles the connector assembly is being used.

Figure 15A:
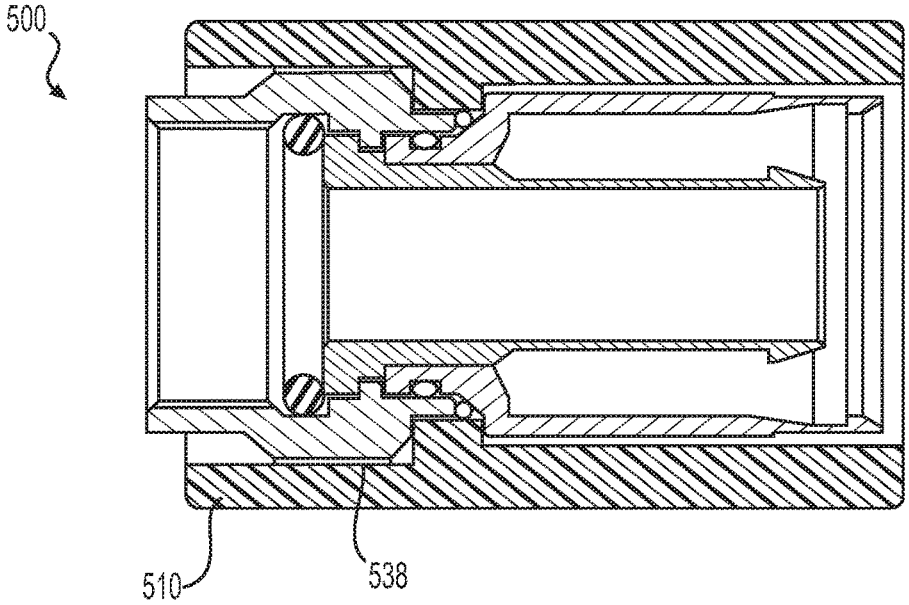
FIGS. 15A and 15B are cross-sectional and front end views, respectively, of a connector assembly according to a fifth exemplary embodiment of the present invention.
Figure 15B:
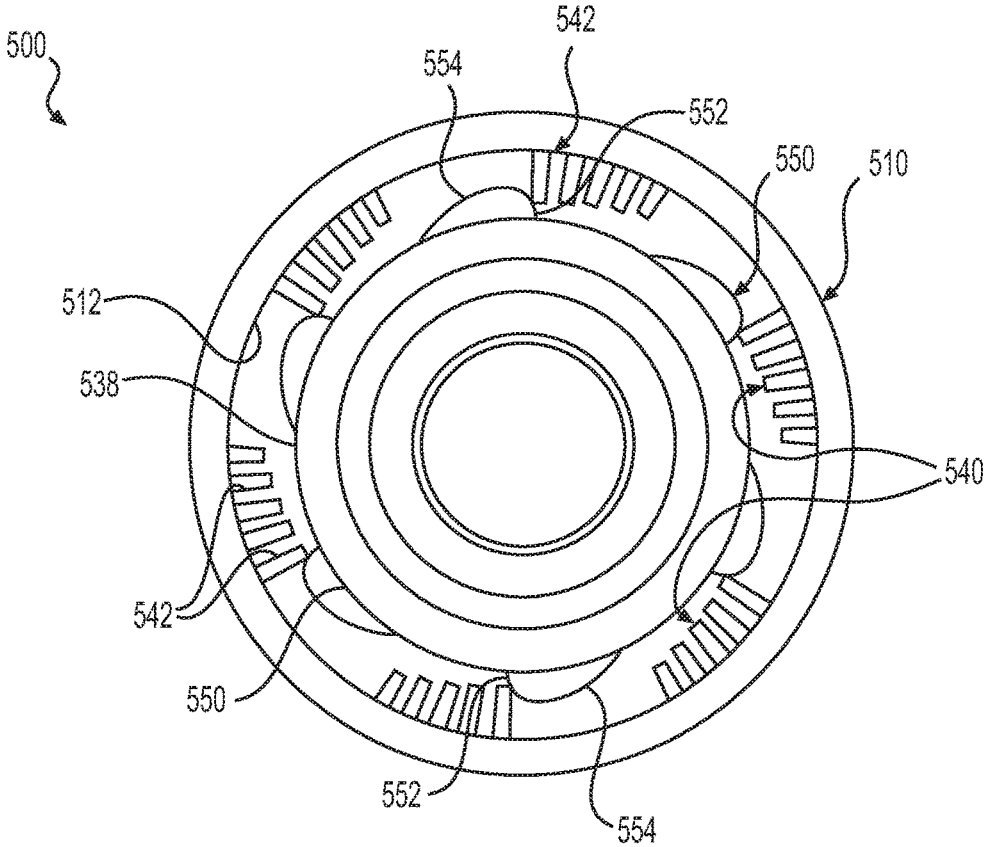

FIGS. 15A and 15B illustrate a fifth exemplary embodiment of a connector assembly 500 according to the present invention. Connector assembly 500 of the fifth embodiment is similar to the fourth embodiment, except that the spring fingers 542 of slip element 540 are not part of a spring that is separate from the gripping sleeve 510. Instead, the spring fingers 542 extend from an inner surface 512 of gripping sleeve 510 and may be integral with gripping sleeve 510. The inwardly extending spring fingers 542 engage the one or more protrusions 550 extending from the outer surface 538 of the coupling member in a similar manner to the fourth embodiment. Like the embodiments above, the torque limiting feature of the fifth embodiment may include two predetermined torque limits for the tightening and loosening directions, respectively, where the predetermined torque limit for the loosening direction is greater than the predetermined torque limit for the tightening direction.

Each protrusion 550 preferably includes a normal surface 552 and a sloped surface 554 extending away from normal surface 552, as best seen in FIG. 15B. The surfaces 552 and 554 are designed to engage the one or more spring fingers 542 such that when sleeve 510 is rotated in the tightening direction, the coupling member also rotates in the tightening direction until the selected and predetermined torque limit is reached, i.e. when fingers 542 clear sloped surface 554, as seen in FIG. 15B, to prevent overtightening; and such that the sleeve 510 may then be rotated in the loosening direction until the second predetermined torque limit is reached, i.e. when fingers 542 clear normal surface 552, to allow the sleeve 510 to rotate and loosen the coupling member, similar to the above embodiments. In one embodiment, the spring fingers 542 may have different depth dimensions (the distance the fingers extend inwardly toward the coupling member), as best seen in FIG. 15B, to adjust the torque limits as desired. The value of the predetermined torque limit may be selected, changed or adjusted by changing the depth dimension of the spring fingers 542, by changing the thickness of the spring fingers 542, and/or changing the height of the protrusions 550. When rotating in the reverse/loosening direction, surfaces 552 and fingers 542 are initially against each other, as seen in FIG. 15B, and create a larger torque force in the loosening direction than those they create during rotation in the tightening direction.

Figure 16A:
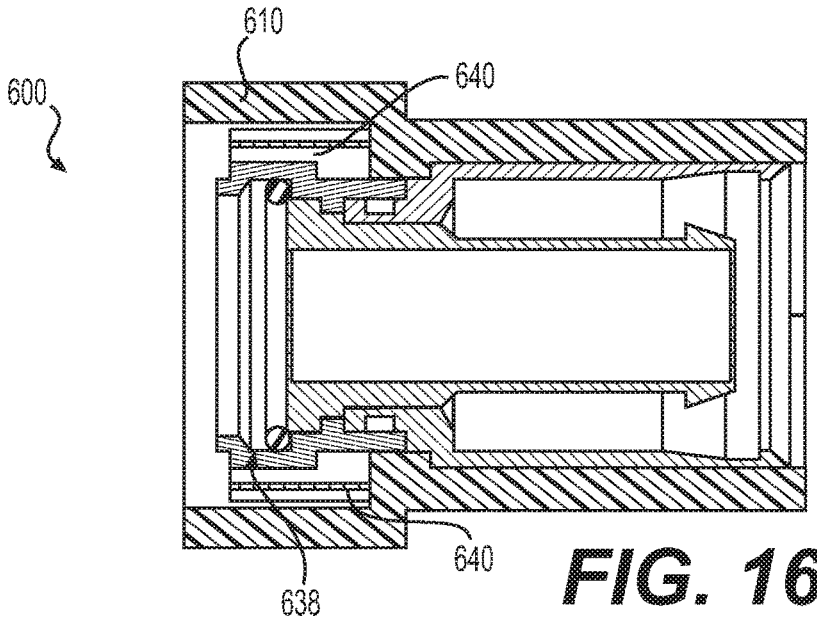
FIGS. 16A and 16B are cross-sectional and front end views, respectively, of a connector assembly according to a sixth exemplary embodiment of the present invention.
Figure 16B:
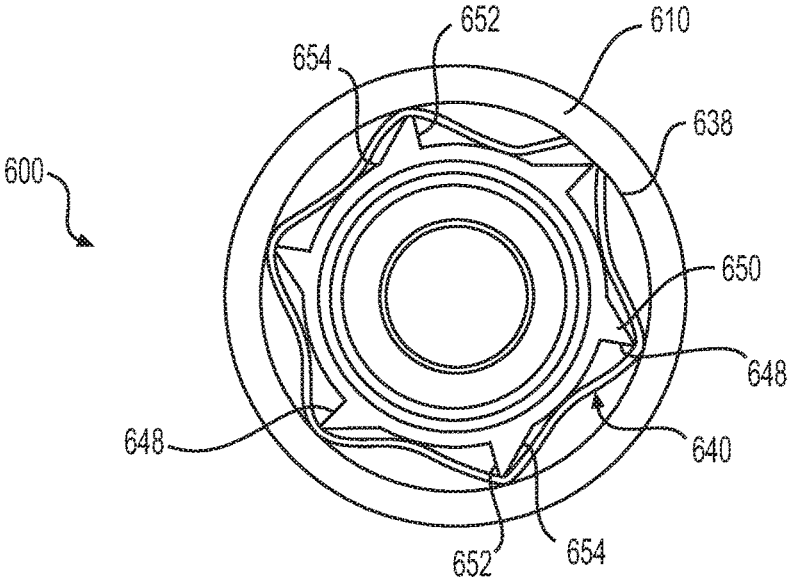
Figure 16C:
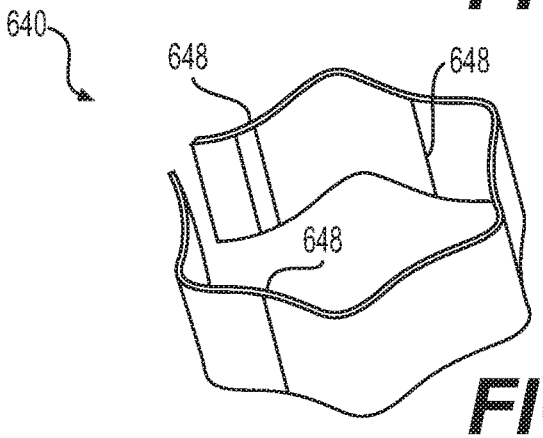
FIG. 16C is a perspective view of a slip element of the connector assembly illustrated in FIG. 16A.

FIGS. 16A-16C illustrate a sixth exemplary embodiment of a connector assembly 600 according to the present invention. Connector assembly 600 of the sixth embodiment is similar to the first embodiment wherein the slip element 640 is a spring that generally surrounds the coupling member and has one or more concave regions forming one or more contact points 648 (FIG. 16C) that engage one or more protrusions 650 (FIG. 16B) on the outer surface 638 of the coupling member.

Each engaging element or protrusion 650 may include a normal surface 652 and a sloped surface 654, as best seen in FIG. 16B. Normal and sloped surfaces 652 and 654 are preferably substantially flat. Contact points 648 of slip element 640 are configured to tangentially and radially engage the sloped and normal surfaces 654 and 652, respectively, when rotating the gripping sleeve 610 in the tightening and loosening directions, respectively, in the same manner discussed in the embodiments above, to prevent overtightening and accidental loosening of the connector, while also allowing release of the connector. That is, the torque limiting feature of the sixth embodiment may include the two predetermined torque limits for the tightening and loosening directions, respectively, where the predetermined torque limit for the loosening direction is greater than the predetermined torque limit for the tightening direction. The depth of the contact points 648 and thickness of spring 640 along with the configuration of the normal and sloped surfaces 652 and 654 of each protrusion 650 provide for and allow adjustment of the two predetermined torque limits. Sloped surfaces 654 allow the contact points 648 to tangentially engage the protrusions 650 so that the gripping sleeve 610 can rotate the coupling member in its tightening direction until the first predetermined torque limit is reached when the slip element 640 disengages from or rides over the sloped surfaces 654, as seen in FIG. 16B, thereby preventing overtightening onto the mating connector. Gripping sleeve 610 may then be rotated with respect to coupling member in the loosening direction until the second predetermined limit is reached when the slip element 640 deforms at contact points 648 to ride over the protrusions 650, thereby allowing the gripping sleeve to rotate the coupling member in the loosening direction.

While particular embodiments have been chosen to illustrate the invention, it will be understood by those skilled in the art that various changes and modifications can be made therein without departing from the scope of the invention as defined in the appended claims.

What is claimed is:

1. A connector assembly, comprising:

a connector including a coupling member rotatably coupled to a body, said coupling member having an interface end configured to engage a mating connector;

a gripping sleeve having a rear end that receives at least a portion of said body and a front end that receives at least a portion of said coupling member; and a torque limiting feature including at least one slip element associated with said front end of said gripping sleeve and at least one engaging element associated with said coupling member, said torque limiting feature having first and second predetermined torque limits, said second predetermined torque limit being greater than said first predetermined torque limit, wherein said slip element and said engaging element engage one another such that rotation of said gripping sleeve applies torque to and rotates said coupling member in a tightening direction until said first predetermined torque limit is reached when said slip element disengages from said engaging element thereby allowing said gripping sleeve to rotate with respect to said coupling member in the tightening direction such that no additional torque is applied to said coupling member by said gripping sleeve that is greater than said first predetermined torque limit, and wherein said gripping sleeve rotates with respect to coupling member in a loosening direction that is opposite the tightening direction until the second predetermined torque limit is reached when said slip element re-engages said engaging element allowing said gripping sleeve to rotate said coupling member in the loosening direction.

2. A connector assembly according to claim 1, wherein said at least one slip element is a spring finger extending inwardly toward said coupling member and said at least one engaging element is a protrusion extending outwardly from an outer surface of said coupling member.

3. A connector assembly according to claim 2, wherein said first predetermined torque limit is at least partially based on a thickness of said spring finger and a depth dimension of said spring finger.

4. A connector assembly according to claim 3, wherein the value of said first predetermined torque limit is based on a height of said protrusion.

5. A connector assembly according to claim 1, wherein said at least one engaging element is integrally formed with said coupling member.

6. A connector assembly according to claim 2, wherein said protrusion includes a sloped surface and a normal surface, said at least one spring finger engages said sloped surface when rotating said gripping sleeve and said coupling member in the tightening direction and engages said normal surface when rotating said gripping sleeve and said coupling member in the loosening direction.

7. A connector assembly according to claim 6, wherein said sloped surface includes a rounded or substantially flat face.

8. A connector assembly according to claim 6, wherein said normal surface is substantially flat.

9. A connector assembly according to claim 6, wherein said spring finger extends from a spring that generally surrounds said coupling member.

10. A connector assembly according to claim 6, wherein said spring finger extends from an inner surface of said gripping sleeve spring, and said spring finger is integral with said inner surface.

11. A connector assembly according to claim 10, wherein a plurality of spring fingers extend from said inner surface of said gripping sleeve, and at least two of said spring fingers have different depth dimensions.

12. A connector assembly according to claim 1, wherein said at least one slip element is a spring that generally surrounds said coupling member, said spring has a substantially wave shape with at least one concave contact point for engaging said engaging element.

13. A connector assembly according to claim 12, wherein a value of said first predetermined torque limit is at least partially based on a depth of said at least one concave contact point and a thickness of said spring.

14. A connector assembly according to claim 1, wherein said torque limiting feature applies a first torque force when said slip element and said engagement element engage one another to rotate said coupling member in said tightening direction and applies a second torque force when said slip element and said engagement element engage one another to rotate said coupling member in said loosening direction, and said second torque force is larger than said first torque force.

15. A connector assembly, comprising:

a connector including a coupling member rotatably coupled to a body, said coupling member having an interface end configured to engage a mating connector;

a gripping sleeve having a rear end that receives at least a portion of said body and a front end that receives at least a portion of said coupling member; and a torque limiting feature including at least one slip element associated with said front end of said gripping sleeve and at least one engaging element associated with said coupling member, said torque limiting feature having first and second predetermined torque limits, said second predetermined torque limit being greater than said first predetermined torque limit, wherein said slip element tangentially engages said engaging element such that rotation of said gripping sleeve applies torque to and rotates said coupling member in a tightening direction until said first predetermined torque limit is reached when said slip element disengages from said engaging element thereby allowing said gripping sleeve to rotate with respect to said coupling member in the tightening direction such that no additional torque is applied to said coupling member by said gripping sleeve that is greater than said first predetermined torque limit, and wherein said gripping sleeve rotates with respect to the coupling member in a loosening direction that is opposite the tightening direction until said second predetermined torque limit is reached allowing said gripping sleeve to rotate said coupling member in the loosening direction.

16. A connector assembly according to claim 15, wherein said torque limiting feature applies a first torque force when said slip element and said engagement element engage one another to rotate said coupling member in said tightening direction and applies a second torque force when said slip element and said engagement element engage one another to rotate said coupling member in said loosening direction, and said second torque force is larger than said first torque force.

17. A connector assembly according to claim 15, wherein said at least one slip element is a spring finger extending inwardly toward said coupling member and said at least one engaging element is a protrusion extending outwardly from an outer surface of said coupling member.

18. A connector assembly according to claim 17, wherein the first predetermined torque limit is based on a thickness of said spring finger, a depth dimension of said spring finger, and a height of said protrusion.

19. A connector assembly according to claim 17, wherein said protrusion includes a sloped surface that provides the tangential engagement with said spring finger and a normal surface that provides the radial engagement with said spring finger.

20. A connector assembly according to claim 15, wherein said slip element is a plurality of annularly spaced spring fingers extending inwardly toward said coupling member and said engaging element is a plurality of annularly spaced protrusions extending outwardly from an outer surface of said coupling member.

21. A connector assembly according to claim 20, wherein said plurality of spring fingers have different depth dimensions.

22. A connector assembly, comprising:

a connector including a coupling member rotatably coupled to a body, said coupling member having an interface end configured to engage a mating connector;

a gripping sleeve having a rear end that receives at least a portion of said body and a front end that receives at least a portion of said coupling member, said gripping sleeve being configured to apply torque to said coupling member; and means for limiting torque applied to said coupling member by said gripping sleeve in both a tightening direction and a loosening direction such that said gripping sleeve applies torque to and rotates said coupling member in the tightening direction until a first predetermined torque limit is reached allowing said gripping sleeve to rotate with respect to said coupling member such that no additional torque is applied to said coupling member by said gripping sleeve beyond said first predetermined torque limit, and such that said gripping element rotates with respect to said coupling member in the loosening direction opposite the tightening direction until said second predetermined torque limit is reached allowing said gripping sleeve to apply torque to and rotate said coupling member in the loosening direction.

23. A connector assembly according to claim 22, wherein said means for limiting torque applies a first torque force when rotating said coupling member in said tightening direction and applies a second torque force when rotating said coupling member in said loosening direction, and said second torque force is larger than said first torque force.

* * * * *